United States Patent [19]

Sargent

[11] Patent Number: 4,920,465

[45] Date of Patent: Apr. 24, 1990

[54] FLOATING FOUNTAIN DEVICE

[75] Inventor: Ronald J. Sargent, Escondido, Calif.

[73] Assignee: Alopex Industries, Inc., San Marcos, Calif.

[21] Appl. No.: 271,735

[22] Filed: Nov. 15, 1988

[51] Int. Cl.[5] ..... F21V 33/00

[52] U.S. Cl. ..... 362/96; 362/192; 362/193

[58] Field of Search ..... 362/96, 192, 193; 464/29

[56] References Cited

U.S. PATENT DOCUMENTS

| | | | |
|---|---|---|---|
| 2,687,915 | 8/1954 | Keech | 362/96 |
| 3,845,291 | 10/1974 | Portyrata . | |
| 3,864,547 | 2/1975 | Ray | 219/343 |
| 4,088,880 | 5/1978 | Walsh | 362/96 |
| 4,305,117 | 12/1981 | Evans | 362/96 |
| 4,564,889 | 1/1986 | Bolson | 362/192 |
| 4,616,298 | 10/1986 | Bolson | 362/192 |

FOREIGN PATENT DOCUMENTS

| | | | |
|---|---|---|---|
| 715943 | of 0000 | Fed. Rep. of Germany . | |
| 725214 | of 0000 | Fed. Rep. of Germany . | |
| 107088 | of 0000 | Sweden . | |
| 1272031 | 11/1986 | U.S.S.R. | 464/29 |
| 998780 | 2/1987 | U.S.S.R. | 464/29 |

*Primary Examiner*—Ira S. Lazarus
*Assistant Examiner*—Sue Hagarman

[57] ABSTRACT

A floating fountain device for a swimming pool includes a fountainhead to create a water fountain and a lamp and generator to illuminate the fountain, the generator being sealed in an envelope and driven by a water turbine through a magnetic coupling.

7 Claims, 4 Drawing Sheets

FLOATING FOUNTAIN DEVICE

BACKGROUND OF THE INVENTION

This invention relates to floating fountain devices for use as swimming pool decorations.

Swimming pools have decorative and aesthetic as well as recreational functions and aspects. Partially as a result of the decorative and aesthetic aspects, various types of pool cleaning mechanisms have been developed to remove dirt and debris from the swimming pool. Many of these cleaning mechanisms use pressurized water entering the pool from a circulation system to disturb the dirt and debris in the pool for more effective filtration and, in some mechanisms, to vacuum the walls of the pool.

One such pool cleaner that has been very successful is shown in U.S. Pat. No. 3,972,339. This cleaner is driven by pressurized water from the return line of the circulation system, and has a vacuum for picking up debris and a sweep hose for creating a jet of water that stirs the dirt settled in the pool, thereby assisting in filtration of the dirt from the water.

The pool owner may remove the pool cleaner from the pool when it is not in use or may leave the cleaner in the pool. The objective of the present invention is to provide a decorative fountain that may be attached to the water return line in place of the pool cleaner when the cleaner is not in use, thereby adding an attractive feature to the pool.

SUMMARY OF THE INVENTION

The present invention resides in a novel fountain device that is attached to a water return line normally used for a pool cleaner. The fountain device is buoyant so as to float in a swimming pool, and receives water under pressure from the water return line and emits a spray of water in a decorative pattern above the surface of the pool. The preferred embodiment of the fountain device has a lamp for illuminating the fountain and enhancing its decorative qualities, and a generator that is driven by a motor powered by the water flow to provide electricity for the lamp.

More specifically, the fountain device according to the present invention includes a central housing that is adapted to receive a flow of water from the water return line of the pool cleaning mechanism, and directs the flow into a fountainhead on top of the housing to form a fountain of water. A plurality of water-tight pods are supported around the central housing on elongated arms to provide buoyancy and stability to the fountain device.

In the preferred embodiment of the invention, one of the pods contains a lamp which lights the water fountain above the fountainhead and the generator is mounted inside the housing in a water-tight envelope. Water flowing through the housing drives a turbine, and a magnetic coupling links the turbine to the shaft of the generator inside the water-tight envelope. Thus, the water flow drives the turbine to turn the generator shaft to generate electricity, which lights the lamp. The result is a floating fountain device that is powered by the pressurized water already provided for the swimming pool cleaning mechanism and includes a self-contained and sealed electrical system for illuminating the water spray forming the fountain, including simple lamp and generator parts that may be off-the-shelf items.

BRIEF DESCRIPTION OF THE DRAWINGS

Other features and advantages of the present invention will be apparent from the following Detailed Description taken in conjunction with the accompanying drawings, in which.

DETAILED DESCRIPTION

Figure 1:
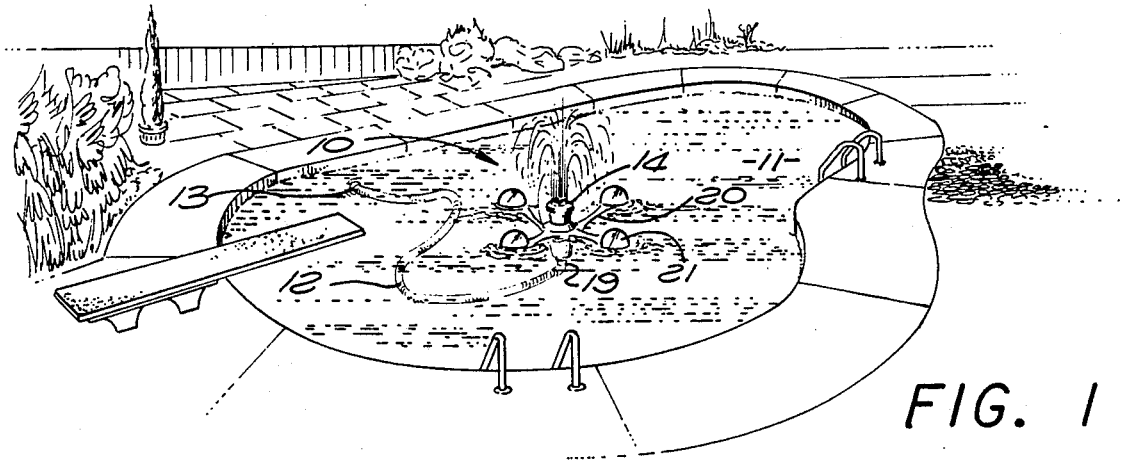
FIG. 1 is a perspective view of a floating fountain device according to the present invention in use in a swimming pool.

As shown in the drawings for purposes of illustration, the invention is embodied in a fountain device, generally indicated by reference numberal 10 in FIG. 1, that is floating in a swimming pool 11 and is attached to an elongated floating hose 12. This hose is attached to an outlet 13 of a conventional water filtration and circulation system (not shown), including a pump for drawing water from the pool, pumping the water through a filter and often a heater, and returning the water to the pool through the outlet 13.

The illustrative hose 12 is of the floating type that is used to supply water under pressure to a pool cleaner such as disclosed in U.S. Pat. No. 3,972,339. In the past, such cleaners either have been left in the pool when not in use, or have been removed and stored in an out-of-the way location. The fountain device 10 is designed for attachment to the hose 12 when the pool cleaner is not in use, and provides an attractive decoration for the pool.

In accordance with the present invention, the fountain device 10 is buoyant, so as to float freely in the pool at the end of the hose, and has a fountainhead 14 for directing the water under pressure from the hose into a decorative spray pattern above the pool. In addition, the device contains a lamp 15 for illuminating the fountain, and a power source for the lamp, preferably in the form of a generator 16 that is driven by a water turbine 17 powered by the flow of water through the device.

Figure 2:
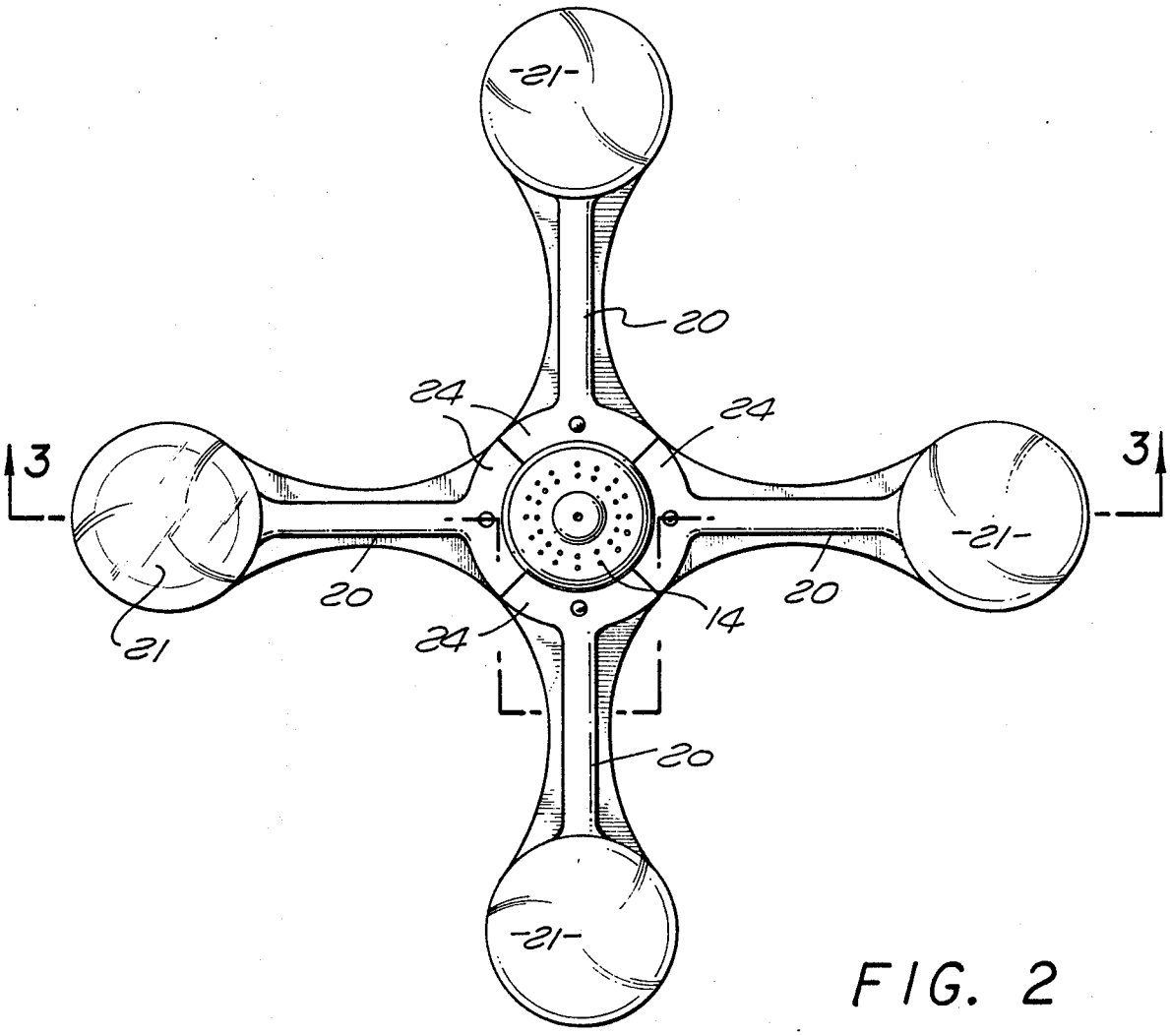
FIG. 2 is a top plan view of the fountain device of FIG. 1.
Figure 3:
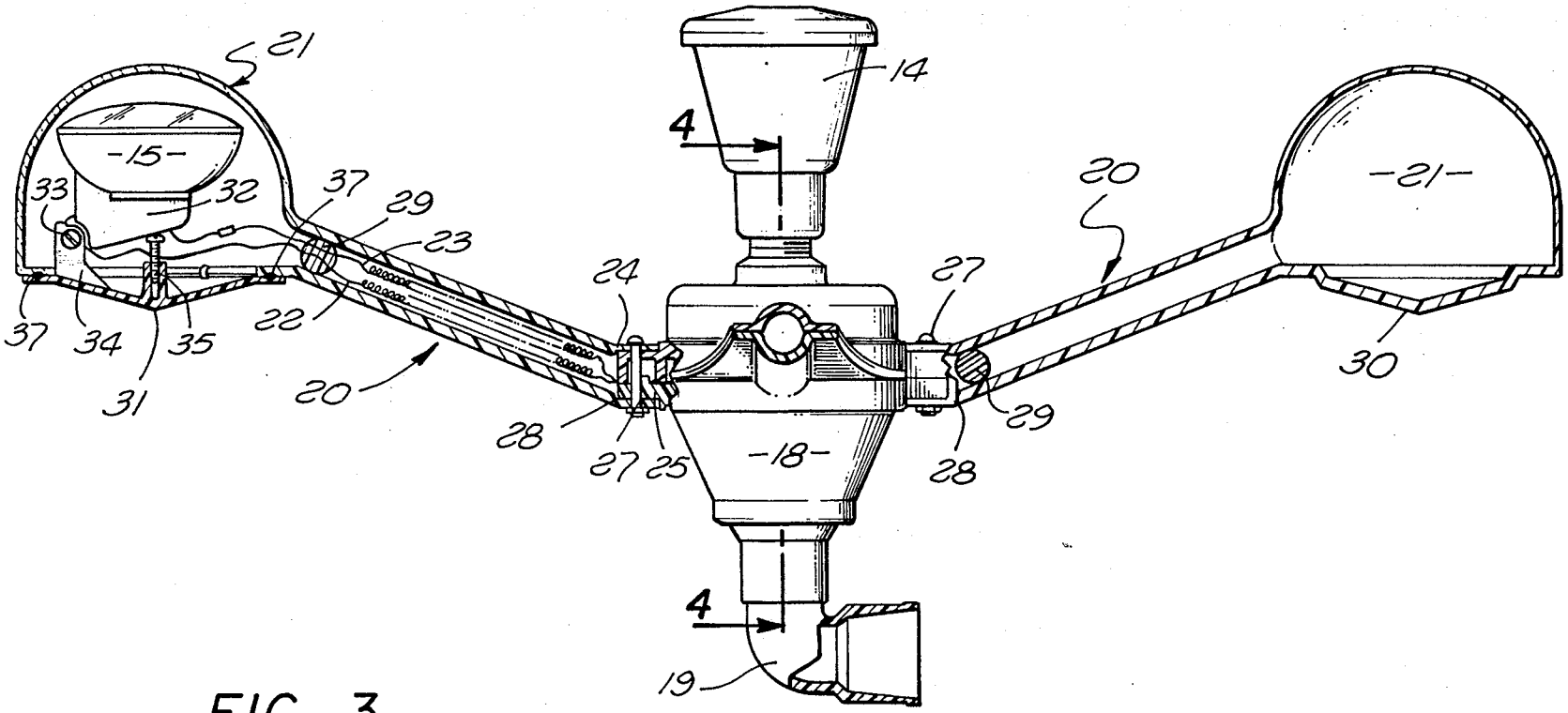
FIG. 3 is an enlarged cross-sectional view taken substantially along line 3—3 of FIG. 2, and with another portion of the device shown in cross-section.

As shown in FIGS. 1, 2 and 3, the fountain device 10 comprises a central housing 18 to the underside of which the hose 12 is connected, at a right-angle fitting 19, and a plurality of arms 20, herein four, that project generally radially outwardly from the housing and carry pod-like floats 21 on their outer ends. The fountainhead is mounted on top of the housing, above the turbine 17 and the generator 16 within the housing, and the lamp 15 is mounted in one of the pod-like floats, the one on the left in FIGS. 2 and 3. Electric wires 22 and 23 extend from the generator outwardly through one of the arms 20 to the lamp.

The arms 20 preferably are hollow molded plastic parts with the floats molded integrally on their outer ends, and have enlarged arcuate inner ends 24 that are shaped to fit over an annular mounting rib 25 that extends around the housing 18. Fasteners, herein bolts 27 extending through aligned holes in the ends 24 and the mounting rib 25 with nuts threaded on their lower ends, connect the arms securely to the housing. The four arcuate inner ends completely cover the mounting rib.

Each arm has a bend 28 adjacent the housing so that the outer portion of the arm angles upwardly to position the float 21 generally level with the fountainhead 14. As can be seen in FIG. 2, the arms 20 have webs on their sides, providing increased strength and enhancing their appearance. For convenience of manufacture, each arm is made in two pieces, upper and lower halves as can be seen in FIG. 3, and the pieces are sealed together between the laterally projecting webs.

Except for the lamp 15, the four arms 20 and floats 21 may be identical being sealed by resilient seals 29 against the entry of water to maintain the buoyancy of the fountain device. The three hollow floats 21 that do not contain the lamp have integrally formed bottom walls 30, preferably generally flat beneath approximately semispherical upper bodies, while the float 21 that houses the lamp has a separate generally flat bottom wall 31 that constitutes a base for the lamp 15 and its associated parts.

As can best be seen in FIG. 3, the lamp 15 is mounted on a bracket plate 32 having a pivot screw 33 on one lower corner, and this pivot screw is supported in an upstanding finger 34 on the bottom wall 31 of the float 21, near its outer or left-hand side as viewed in FIG. 3. The lamp overlies an adjusting screw 35 in the center of the bottom wall, for abutting against the underside of the bracket plate 32 and determining its angular position about the pivot screw. This sets the direction of the beam of light produced by the lamp for optimum illumination of the fountain.

Such setting is to be done at the factory, and the bottom wall is to be securely attached to the underside of the float, for example, by an adhesive seal shown at 37. The wires 22 and 23 extend out to the lamp through the hollow arm 20, excess wire preferably being provided for use in replacing the lamp after it burns out. The seal 29 in this arm is located adjacent the float 21.

Figure 4:
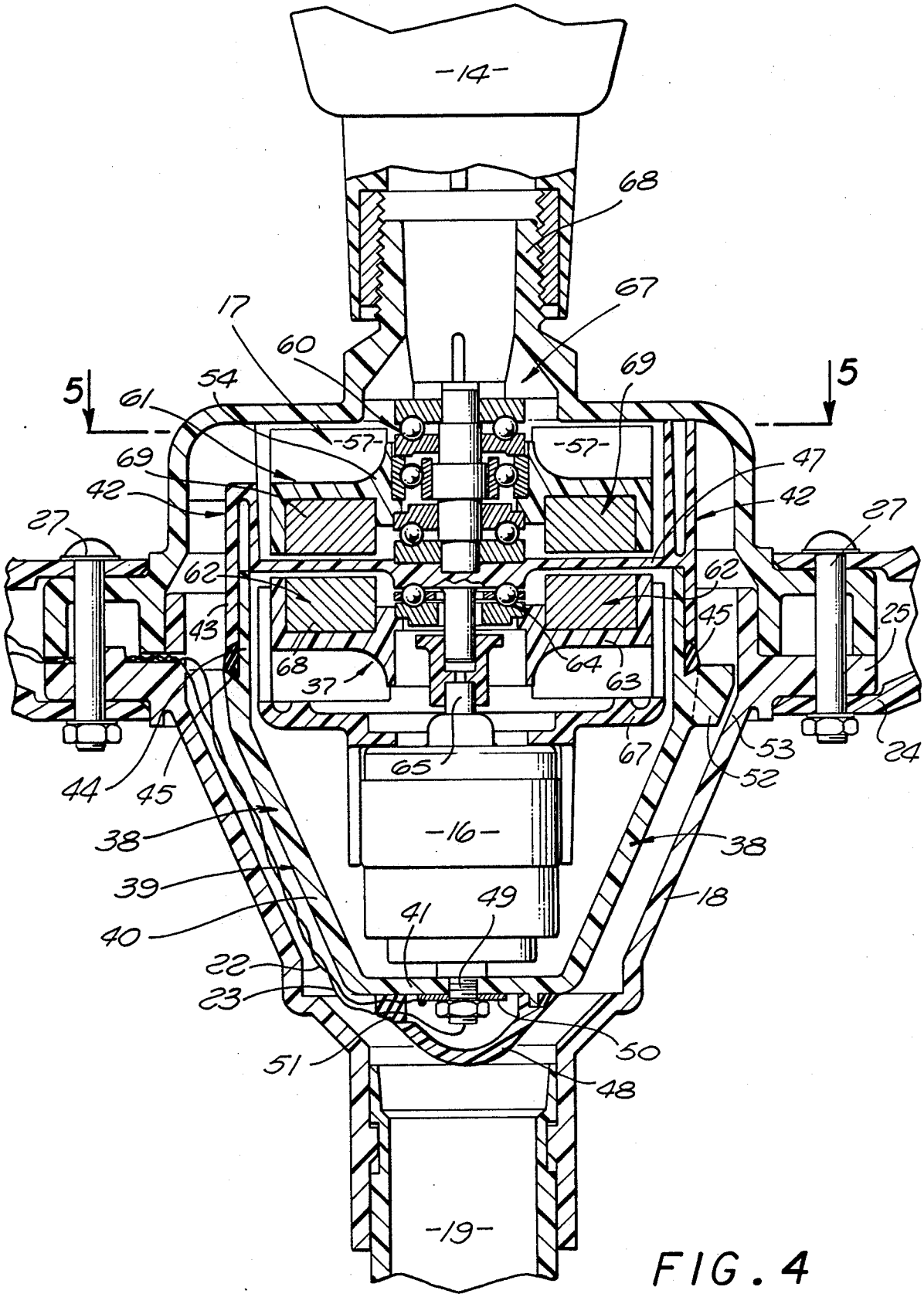
FIG. 4 is a further enlarged fragmentary cross-sectional view taken substantially along line 4—4 of FIG. 3.

The water turbine 17 and the generator 16 are mounted in the housing 18, the generator and its driving coupling element 37 being sealed within a waterproof envelope 38 that protects the generator from exposure to water at any time. As shown in FIG. 4, this envelope comprises a lower portion or base 39 having a downwardly tapering sidewall 40 and a lower end wall 41 on which the generator is mounted, and an upper cap 42 including a skirt 43 which telescopes tightly over the upper end or rim 44 of the base, being sealed at 45, and a recessed top wall 47 that extends across the top of the base and completes the envelope A sealed cap 48 covers a screw 49 at the lower end of the base, the wires 22 and 23 being suitably joined to the screw 49 and to a washer 50 thereon and exiting through the seal 51.

It can be seen that the inner envelope 38 is spaced inwardly from the housing 18 to define flow passages upwardly from the fitting 19 on the lower end of the housing. This positioning is maintained by ribs 52 which bear against an internal shoulder 53 in the housing to provide vertical support, and against the inner wall of the housing to provide lateral support.

Figure 5:
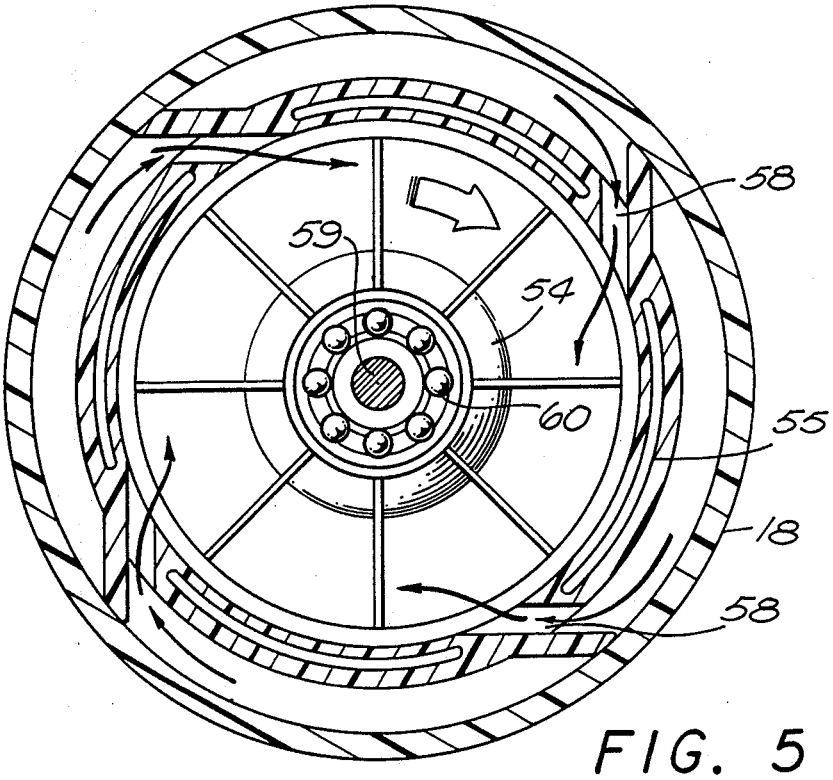
FIG. 5 is an enlarged cross-sectional view taken substantially along line 5—5 of FIG. 4.

The water turbine 17 is mounted in the housing 18 on top of the envelope 38, in the recessed top wall 47 thereof, and comprises a turbine wheel 54 rotatably supported in a housing 55 and having a plurality of turbine blades 57 (see FIGS. 4 and 5), and means for directing water under pressure into the turbine housing and against the blades in a manner that will spin the turbine wheel. As shown in FIG. 5, the water-directing means comprise a plurality of water inlets 58 in the housing for directing jets of water generally tangentially into the wheel and against the blades, for clockwise rotation as indicated by the arrows in FIG. 5. The wheel is mounted on an upright shaft 59 by means of a set of anti-friction ball bearings, indicated generally at 60, and thus spins freely in response to the water jets.

To transmit this motion to the generator 16 through the sealed top wall 47 of the envelope, a magnetic coupling is provided, having an upper, driving coupling half 61 carried on the underside of the turbine wheel 54 and a lower, driven coupling half 62 that is rotatably mounted in the envelope, beneath the top wall 47, to drive the generator. The lower coupling half comprises a wheel 63 that is rotatably mounted on an anti-friction bearing 64 in the envelope and coupled to the input shaft 65 of the generator. This wheel is mounted in a cup-like support 67 on top of the generator, and carries one or more permanent magnets 68 in closely spaced relation with one or more similar magnets 69 on the turbine wheel 54, but on opposite sides of the top wall of the envelope. Thus, as the turbine wheel spins, it carries with it the driven coupling half 62 which similarly spins the generator shaft 65 to generate electricity for the lamp 15.

Figure 6:
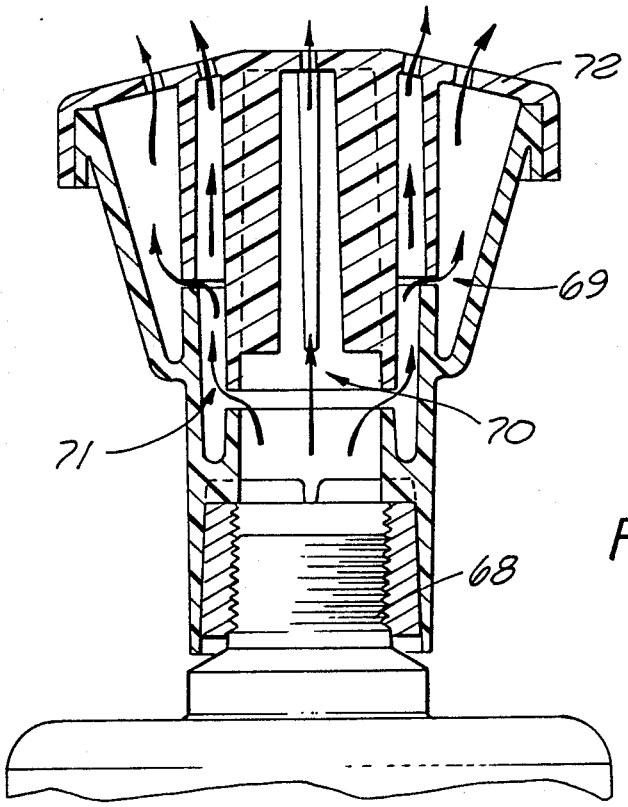
FIG. 6 is a partial cross-sectional view of the fountainhead, taken in substantially the same plane as FIG. 4.

After passing through the turbine 17, the flow of water exits from the housing 16 through an outlet passage 67 in the top wall thereof, in a tubular neck 68 on which the fountainhead 14 is mounted. The illustrative fountainhead, shown in FIG. 6, is threaded onto the neck 68 to receive the flow of water and divide it into a plurality of passages 69, 70, 71 leading to discharge holes in the top wall 72 of the head. The head is removable from the neck, permitting use of interchangeable heads (not shown) for providing different decorative fountain patterns.

The fountain device 10 preferably is made of suitable plastic materials, such as clear or translucent polyvinylchloride or polycarbonates. The fountain device uses off-the-shelf electrical and mechanical parts, and in particular a conventional generator and lamp assembly, sold as a bicycle accessory, such as the six volt, 2.4 watt Sanyo Model No. NH-140 SYE(H) and also the Filtronics PE 231-1 turbine/magnet and associated bearing assemblies.

From the foregoing, it will be seen that the present invention provides a novel floating fountain device for use in a swimming pool to emit a decorative spray that is illuminated by a self-contained lamp and water-driven power source, and does so in a relatively simple manner that makes use of relatively inexpensive parts. It also will be evident that, although a particular preferred embodiment has been illustrated and described, various modifications and changes may be made without departing from the spirit and scope of the invention.

We claim as our invention:

1. A floating fountain device for use in a swimming pool comprising:

a central housing having a plurality of hollow, radially projecting arms thereon each having a pod-like float on its outer end, said housing and said arms being buoyant to float the device on the surface of a pool, and one of said floats having a separate bottom wall sealed to the underside of the float;

means defining an inlet for admitting water under pressure into a lower end of said housing and an outlet for water to flow out of the upper end of the housing;

a fountainhead connected to the central housing for receiving flowing pressurized water that passes through the housing and ejecting the water from the housing to form a fountain of water;

an electric lamp mounted in said one float on said bottom wall thereof, and positioned to direct a beam of light into the fountain of water;

a waterproof sealed envelope in said housing supported in spaced relation with the housing to form flow passages from the inlet toward the outlet;

an electricity generator sealed in said envelope and having wires for electrically connecting the generator to said lamp through one of said arms;

a water turbine mounted in said housing above said envelope and having inlet openings for receiving water under pressure from said flow passages and forming driving jets for the turbine, said turbine being positioned beneath said outlet to deliver the water from the turbine to the fountainhead;

and a magnetic coupling having a first coupling half carried by said turbine and a second coupling half spaced beneath said turbine within said envelope and coupled to said generator to drive the generator and thereby provide electricity to said lamp.

2. A floating fountain as defined in claim 1 wherein said envelope has a recessed top wall with said water turbine and first coupling half mounted therein.

3. A floating fountain as defined in claim 1 wherein said generator and said lamp are a bicycle generator and lamp assembly.

4. A floating fountain as defined in claim 3 wherein said housing has four arms, each having a bend adjacent the housing and upwardly inclined therefrom, said floats being substantially level with said fountainhead.

5. A fountain device for use in a swimming pool, comprising:

a central housing means defining an inlet for admitting a flow of water into under pressure into said housing an outlet for water to flow out of the housing, and a flow path for the water through the housing between said inlet and said outlet;

a fountainhead carried on said housing for receiving the flow of water from said outlet and emitting the water upwardly from the housing as a fountain of water;

an electric lamp mounted on said housing and positioned to direct a beam of light into the fountain of water;

an electric generator connected to said lamp and mounted in said housing in a watertight sealed envelope and having a driven shaft;

a water turbine mounted in said housing outside said sealed envelope and positioned in the flow of water between the inlet and said fountainhead, said turbine having a drive shaft rotated by said turbine and generally coaxial with said driven shaft; and a magnetic coupling between said shafts including a driven coupling half inside said envelope on said driven shaft and a driving coupling half outside said envelope on said driving shaft, to drive the generator in response to said water flow.

6. A fountain device as defined in claim 5 in which said envelope is mounted in said housing beneath said fountainhead in spaced relation with said housing to define water flow passages alongside the envelope, and said turbine is mounted above said envelope between the latter and said fountainhead, said inlet being in the bottom of the housing.

7. A floating fountain device as defined in claim 5 wherein said lamp is offset laterally to one side of the fountainhead.

* * * * *